US005419557A

United States Patent [19]

Kirkland et al.

[11] Patent Number: 5,419,557

[45] Date of Patent: May 30, 1995

[54] LOTTERY BALL MIXING AND SELECTING APPARATUS

[76] Inventors: Danny R. Kirkland; Melvin L. Kirkland, both of Rte. 3, Box 200, Alvarado, Tex. 76009

[21] Appl. No.: 231,384

[22] Filed: Apr. 22, 1994

[51] Int. Cl.[6] ..... A63F 9/00

[52] U.S. Cl. ..... 273/144 B; 273/144 A

[58] Field of Search ..... 273/144 R, 144 A, 144 B, 273/148 R

[56] References Cited

U.S. PATENT DOCUMENTS

| | | | |
|---|---|---|---|
| 4,583,736 | 4/1986 | Lorraine | 273/144 B |
| 4,786,056 | 11/1988 | Dunigan | 273/144 A |
| 5,050,880 | 9/1991 | Sloan | 273/144 B |

*Primary Examiner*—Vincent Millin
*Assistant Examiner*—William M. Pierce
*Attorney, Agent, or Firm*—Arthur F. Zobal

[57] ABSTRACT

A cage having rotatable paddles coupled to an electrical motor is provided for retaining and mixing lottery balls. A transparent enclosed chute for retaining and displaying a given number of selected lottery balls is located adjacent the cage. Cage inlet and outlet openings connect the cage and the chute. Lottery balls enter the chute through the cage outlet opening and exit the chute through the cage inlet opening after being viewed. A gate adjacent the cage inlet opening holds the selected lottery balls in the chute until all the balls are selected and viewed. An electrical circuit having a switch located in the chute is provided which deactivates the motor when actuated by the last ball in the chute to be selected and hence when the desired number of lottery balls are in the chute. The electrical circuit has another switch for opening the gate to allow the balls in the chute to pass back into the cage after viewing.

18 Claims, 6 Drawing Sheets

21

LOTTERY BALL MIXING AND SELECTING APPARATUS

BACKGROUND OF THE INVENTION

1. Field of the Invention

The present invention relates to lottery selection machines in particular a lottery selection machine for selecting and displaying lottery balls in an enclose chute.

2. Description of the Prior Art

U.S. Pat. Nos. 5,121,920; 4,871,171; 4,846,476; 4,834,385; 4,813,676; and 4,699,382 disclose different types of lottery ball selection devices. A lottery ball mixing and selection device against which the operator competes should not allow the operator to handle or touch the selected lottery balls. A lottery ball mixing and selection device which allows easy viewing of the selected lottery balls but which prevents operator from handling the balls is desirable.

SUMMARY OF THE INVENTION

It is an object of the present invention to provide a motorized lottery ball mixing and selecting apparatus for selecting multiple lottery balls where the selected lottery balls are retained within an enclosed chute for viewing.

It is a further object of the present invention to provide an electrical circuit in a motorized lottery ball selecting apparatus having an enclosed chute which includes a switch within the chute for deactivating the motor of the apparatus when the desired number of lottery balls are in the chute.

The apparatus of the invention comprises a cage for retaining lottery balls and a rotatable paddle device located in the cage for mixing lottery balls within the cage. An electric motor is coupled to the rotatable paddle device for rotating the paddle device. A chute enclosed by chute walls and the cage is located adjacent the cage. An outlet from the cage to the chute allows lottery balls to enter the chute from the cage. An inlet from the chute to the cage enables the selected lottery balls to re-enter the cage after being viewed. The paddle device, when rotated, cause the balls to move toward the outlet. Balls which move in a given path will enter the chute through the outlet.

In a further aspect, an electrical circuit is provided which includes at least one switch in the chute which is actuated by the last ball in the chute to be selected to deactivate the motor.

DESCRIPTION OF THE PREFERRED EMBODIMENT

Figure 1:
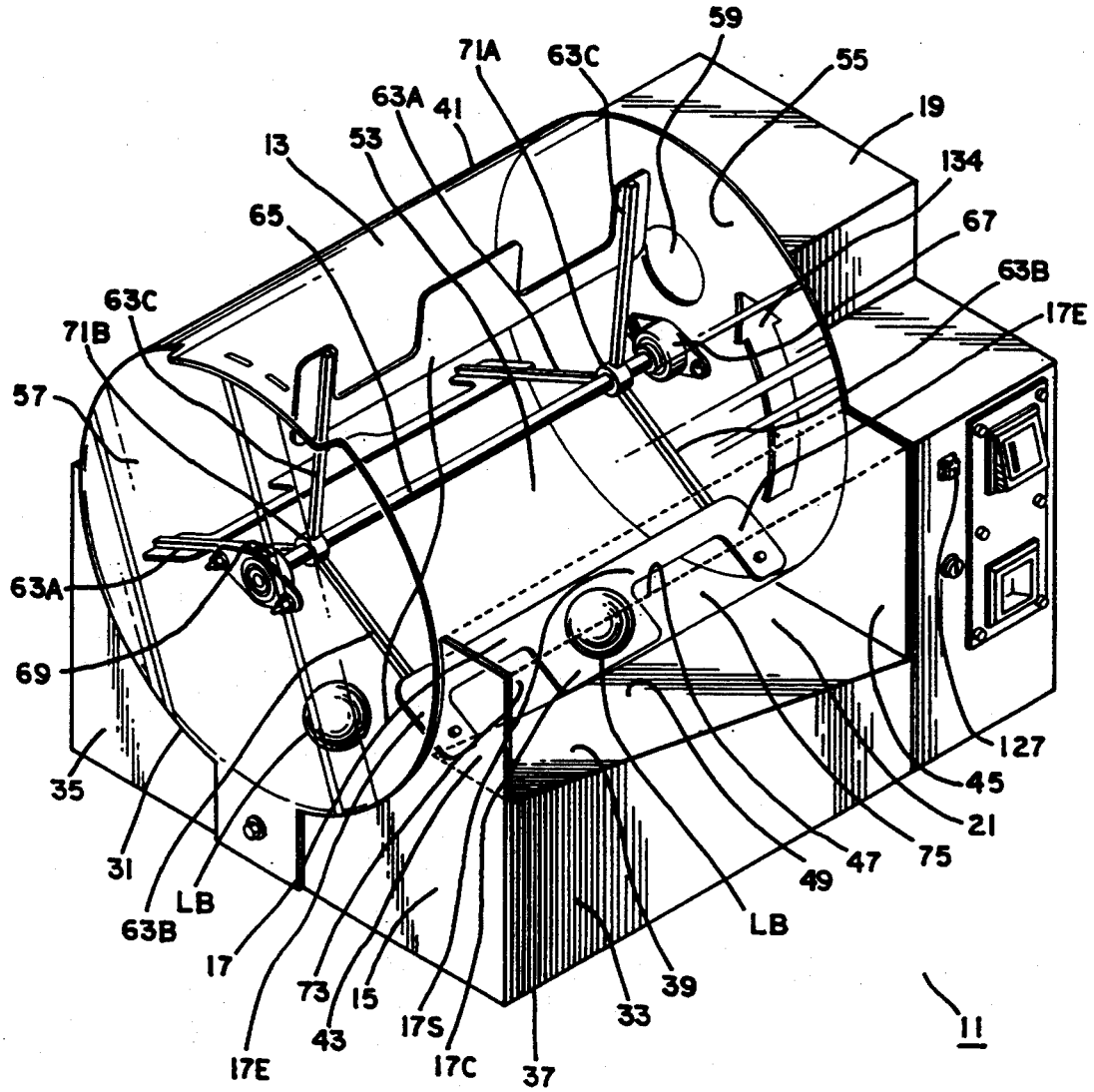
FIG. 1 is an isometric view of the lottery ball mixing and selecting apparatus of the present invention.

Referring now to FIG. 1, the apparatus of the invention is identified by reference numeral 11. The apparatus 11 has a transparent cylindrical cage 13 supported on a base 15. Lottery balls LB are located in the cage 13 when the apparatus is to be used for gaming purposes. There may be fore example 50 lottery balls numbered 1–50 located in the cage. Three rotatable paddles 17 are located in the cage 13 for mixing the lottery balls. A coin-activated electric motor 121 (see FIG. 7) located in a motor housing 19 adjacent the cage 13 is used to rotate the paddles 17 in the direction of the arrow 13A.

Figure 2:
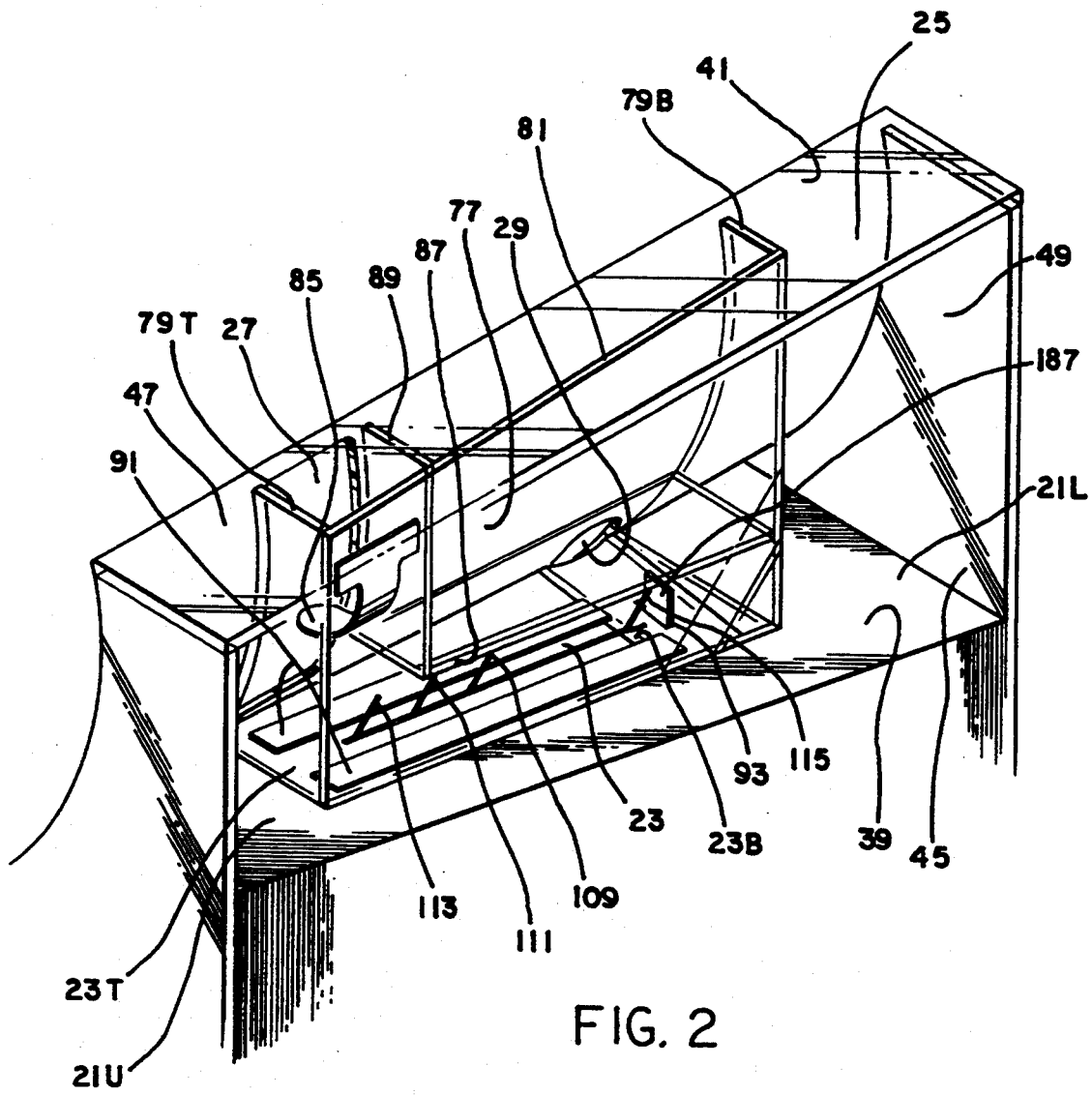
FIG. 2 is an isometric view of the chute of the apparatus of the invention.

The paddles move the balls to allow them to enter a chute 21 located adjacent the cage 13 by way of an outlet opening 27. As shown in FIG. 2, the chute 21 has a ramp 23 upon which the selected lottery balls are located. The lottery balls on the ramp 23 are visible through a transparent housing 25 of the chute 21 which covers the ramp 23. The lottery balls enter the chute 21 from the cage 13 through the cage outlet opening 27 located between the cage 13 and the chute 21 at the top end 23T of the ramp. After the selected lottery balls have been displayed on the ramp 23 they are released back into the cage 13 through a cage inlet opening 29 located between the cage 13 and the chute 21 at the bottom end 23B of the ramp.

Referring back to FIG. 1, the base 15 supports the cage 13 and the chute 21. The base 15 is comprised of a sturdy box having a cradle 31 extending centrally through the upper portion of the box. The cradle 31 receives and supports the cage 13 in a stable position. The cradle 31 is formed by an arcuate wall of the base 15 that extends from the front section 33 of the base 15 to the back section 55 of the base 15 through the top of the base 15. The cage 13 is bolted to the base 15 to firmly secure the cage 13 in the cradle 31 of the base 15. A flat bottom portion 37 of the base 15 enables the base 15 and the attached cage 13 to be stably located on a flat surface.

The front section 33 of the base 15 supports the chute 21 adjacent the cage 13 located in the cradle 31. The floor 39 of the chute 21 upon which the ramp 23 is located is formed by an upper wall of the front section 33 which extends adjacent to the cylindrical wall 41 of the cage 13. End walls 43, 45 of the front section 33, outer transparent walls 47, 49 and the cylindrical wall 41 of the cage 13 extend about the ramp 23 and form the housing 25 of the chute 21.

The motor housing 19 is coupled to the base 15 along a side of the base 15 so that a portion of the motor housing 19 is located adjacent the cage 13. A shown in FIGS. 6 and 7, an electric motor 121, a fan 125 for cooling the motor 121, and a coin box 51 for collecting coins are located within the motor housing 19.

Figure 7:
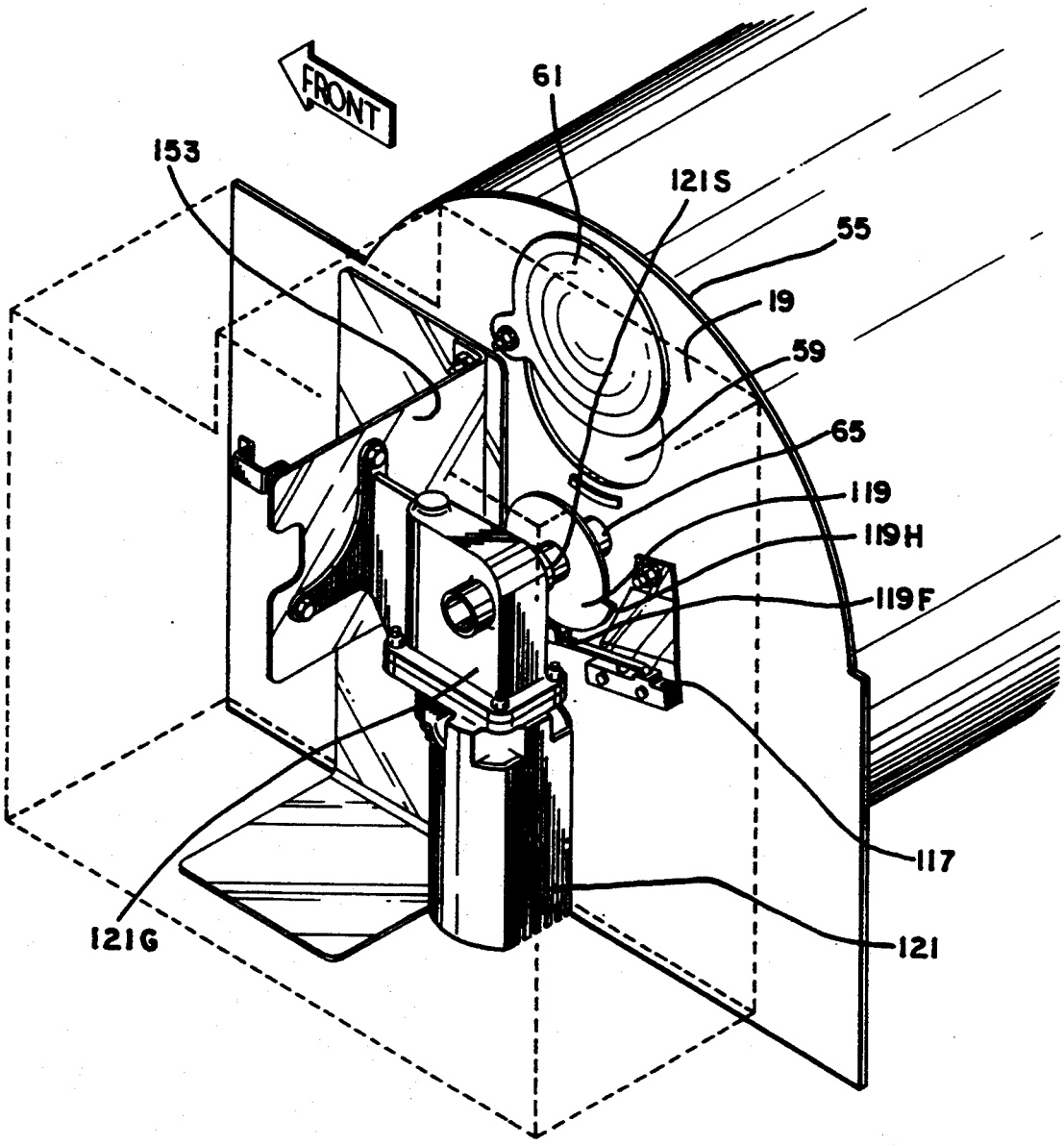
FIG. 7 is a view of the electric motor within the motor housing as seen from FIG. 1 rotated 180°.

Referring again to FIG. 1, the cage 13 will now be described in greater detail. An enclosure 53 for holding lottery balls is formed by the cylindrical wall 41 of the cage 13 and cage ends 55, 57 that are coupled to the ends of the cylindrical wall 41. Lottery balls may be inserted into or removed from the enclosure 53 through a circular aperture 59 in cage end 55. As shown in FIG. 7, a lid 61 is pivotally coupled to the cage end 55 outside the enclosure 53 so that the lid 61 is pivoted to a location covering the aperture 59 to prevent lottery balls from escaping the enclosure 53 through the aperture 59. The motor housing 19 is located against the cage end 55 so that the motor housing 19 covers a substantial portion of the aperture 59, thereby preventing unauthorized removal or insertion of lottery balls.

Rotatable paddles 17 are located in the cage enclosure 53 for mixing the lottery balls and for lifting the lottery balls to the cage outlet openings 27 for selection. Paddle extension bars 63A, 63B, 63C couple the rotatable paddles 17 to a paddle shaft 65 that is coupled by way of a gear 121G to the drive shaft of the electric motor 121. The motor 121 causes the paddle shaft 65 to rotate when the motor 121 is on, which in turn causes the paddles 17 to rotate.

The paddle shaft 65 is mounted in the cage 13 extending along the longitudinal axis of the cage 13. The paddle shaft 65 extends between shaft bearing mounts 67, 69 which secure the paddle shaft 65 between the cage ends 55, 57 of the cage 13 and allow the shaft 65 to rotate. One end of the paddle shaft 65 extends through shaft mount 67 and through cage end 55 and is connected to a gear system driven by the electric motor 121 (see FIG. 7).

Each paddle 17 is coupled to a pair of paddle extension bars 63A, 63B, 63C so that the paddles 17 extend adjacent the cylindrical wall 41 the length of the cylindrical wall 41. Each paddle 17 has an end portion 17E located adjacent each cage end 55, 57 and a center portion 17C located centrally along the cylindrical wall 41 with an inwardly located paddle spine 17S extending between and integrally coupling the end portions 17E and the center portion 17C of the paddle 17. The outer edge of each paddle 17 along the center portion 17C and along the end portions 17E is located close to the cylindrical wall 41, and the end portions 17E of each paddle are located close to cage ends 55, 57, respectively, so that lottery balls are prevented from falling off a paddle 17 between the cylindrical wall 41 or cage ends 55, 57 and the paddle 17.

Notches 73, 75 are formed in each paddle 17 along the outer edge of the paddle 17. Each notch 73, 75 extends between the center portion 17C and an end portion 17E of the paddle 17. Notch 73 is located on the paddle 17 so that notch 73 will extend across the cage outlet opening 27 (see FIG. 2) when the paddle 17 is located across the cage outlet opening 27. Notch 75 is located on the paddle 17 so that notch 75 extends across the cage inlet opening 29 (see FIG. 2) when the paddle 17 is located across the cage inlet opening 29. Each notch 73, 75 has a length and a width sufficient to allow lottery balls to fit through the notch 73, 75.

As the paddle 17 rotates along the bottom of the cage 13, it scoops up lottery balls located at the bottom of the cage with the center 17C and end portions 17E of the paddle 17. As the paddle 17 rotates further towards the side of the cage 13 and upward, the lottery balls located on the paddle 17 slip through the notches 73, 75. Lottery balls slipping through notch 73 as the paddle 17 passes the cage outlet opening 27 may fall through the cage outlet opening 27 and into the chute 21. As the paddle 17 approaches the top of the cage 13 all lottery balls remaining on the paddle 17 fall to the bottom of the cage 13.

As shown in FIG. 2, the cage 13 is located in the cradle 31 of the base 15 so that the cage outlet opening 27 and the cage inlet opening 29 are located adjacent the chute 21. The enclosure 53 and the chute 21 communicate through the openings 27, 29 so that the lottery balls may enter the chute 21 from the enclosure 53 through the cage outlet opening 27, and the lottery balls may re-enter the enclosure 53 from the chute 21 through the cage inlet opening 29 upon their release from the ramp 23.

The cage outlet opening 27 and the cage inlet opening 29 are formed through the cylindrical wall 41. The outlet opening 27 and the inlet opening 29 are spaced in the cylindrical wall 41 so that the ramp 23 extends between the openings 27, 29. The outlet opening 27 is located adjacent the top end 23T of the ramp so that lottery balls entering the chute 21 through the outlet opening 27 roll down the ramp 23. The inlet opening 29 is located adjacent the bottom end 23B of the ramp 23B so that lottery balls released from the ramp 23 roll down the ramp 23 and may pass trough the inlet opening 29 into the enclosure 53.

Figure 3:
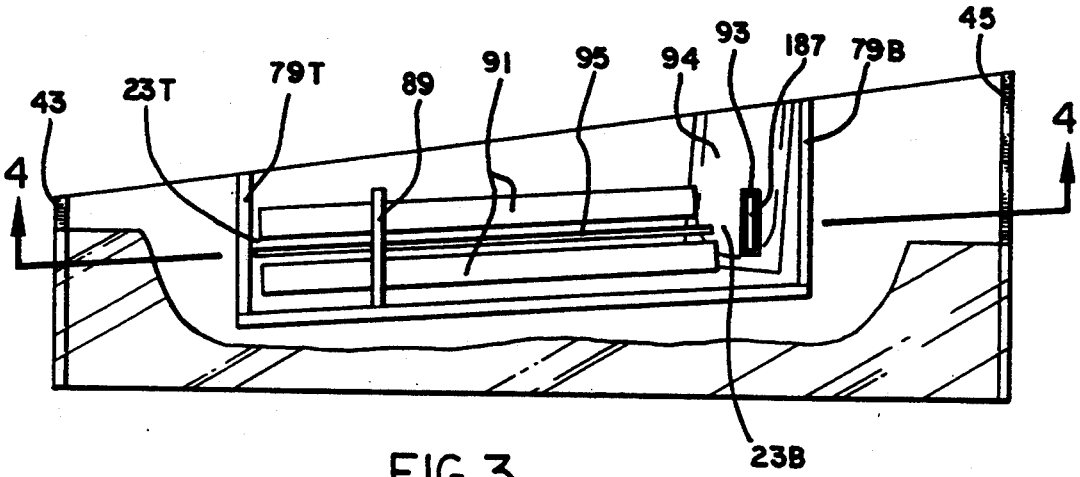
FIG. 3 is a top down plan of the chute of the apparatus of the invention.

The cage outlet opening 27 is relatively large compared to the cage inlet opening 29 so that lottery balls will more easily enter the cage outlet opening 27 from the enclosure 53 but will not as easily enter the cage inlet opening 29 from the enclosure 53. The cage inlet opening 29 is a rectangular aperture formed through the cage wall 41 having a length and a width that are sized slightly greater then the diameter of a lottery ball in the apparatus 11. Lottery balls rolling down the ramp 23 can pass through the cage inlet opening 29 into the enclosure 53, however it is difficult for lottery balls in the enclosure to enter the chute 21 through the cage inlet opening 29 due to the size of the opening 29. In addition, a normally closed gate 187 (see FIG. 3) will prevent the balls from entering the chute through the opening 29. The cage outlet opening 27 is a rectangular shaped aperture formed through the cylindrical wall 41 having a length and a width greater than that of the opening 29 so that lottery balls may enter the chute 21 through the cage outlet opening 27 from the enclosure 53 when they are in the proper position.

Referring now to FIGS. 2–5, the chute 21 is shown in detail. Outer transparent walls 47, 49, end walls 43, 45, and the cylindrical wall 41 of the cage 13 form the chute housing 25. The chute 21 is completely enclosed by the chute housing 25 to prevent unauthorized access to the lottery balls located in the chute 21. Within the chute housing 25, the chute floor 39 slopes downwards at an angle theta from an upper end of the chute 21U to a lower end of the chute 21L. The angle theta may be about 25 degrees.

The ramp 23 is located on the chute floor 39 adjacent the cylindrical wall of the cage 41 within a transparent ramp housing 77 that is located within the chute housing 25. The ramp housing 77 is enclosed about the ramp 23 and the cage outlet and inlet openings 27, 29. The ramp housing 77 is formed by the cylindrical wall 41 of the cage 13 and inner transparent walls 79T, 79B, and 81. The inner transparent walls 79T, 79B, and 81 are coupled to and extend transversely between the chute floor 39 and outer transparent wall 47. The distance between transparent wall 81 and the cylindrical wall 41 is sufficient to form a narrow passage about the ramp 23 which maintains lottery balls entering the chute 21 in single file on the ramp 23 and allows them to roll down the ramp.

Within the ramp housing 77, overhang wall 87 and tongue 85 also maintain single file order among the lottery balls entering the chute 21. The overhang wall is located over the ramp 23 at a distance slightly greater than the diameter of the lottery balls to prevent lottery balls within the chute 21 from becoming located on top of each other. The overhang wall 87 is supported by support wall 89 and is connected to wall 47 and by wall 79B. The support wall 89 is coupled to and extends between outer transparent wall 47 and overhang wall 87 lengthwise and between inner transparent wall 81 and the cylindrical wall 41 widthwise. The overhang wall 87 extends over the length of the ramp 23 from inner transparent wall 79B to the support wall 89.

The tongue 85 prevents multiple lottery balls from blocking the cage outlet opening 27 by guiding lottery balls falling into the chute 21 from above the tongue 85 back into the enclosure 53 through the cage outlet opening 27. The tongue 85 is coupled to inner transparent wall 81 inside the ramp housing 77 facing the upper portion of the cage outlet opening 27. The tongue 85 extends over the ramp 23 adjacent the support wall 89 so that the tongue 85 is located to receive lottery balls falling into the chute 21 from the upper portion of the cage outlet opening 27.

The ramp 23 extends from an upper end 23T located adjacent the cage outlet opening 27 to a lower end 23B located adjacent gate 187. Parallel raised guide strips 91 are located on the floor 39 of the chute 21 extending the length of the ramp 23. The guide strips 91 guide lottery balls entering the ramp 23 down the ramp 23. Gate 187 at the bottom of the ramp 23B retains lottery balls on the ramp 23 until the lottery balls are to be released from the ramp 23. When the lottery balls are to be released, a solenoid 185 located within the base 15 below the chute floor 39 is activated thereby drawing the gate 187 through gate aperture 93 in the chute floor 39 and allowing the lottery balls to roll down the ramp 23 into delivery channel 94 which guides the lottery balls out the cage inlet opening 29.

A slot 95 in the chute floor 39 extends lengthwise down the center of the ramp 23 between the guide strips 91. Switches 109,111,113 and 115 extend through the slot 95 angled towards the bottom of the ramp 23B. All three of the switches 109, 111, and 113 are actuated when the desired number of lottery balls are on the ramp 23. Switch 115 is actuated when a lottery ball is at the lower end 23B of the ramp 23. Each switch 109, 111, 113 and 115 is activated by a lottery ball being located on the switch. Switches 109, 111, 113 and 115 toggle between an angled upright position when no lottery ball is located on the switch, and a flattened activated position when a lottery ball is located on the switch.

Figure 4:
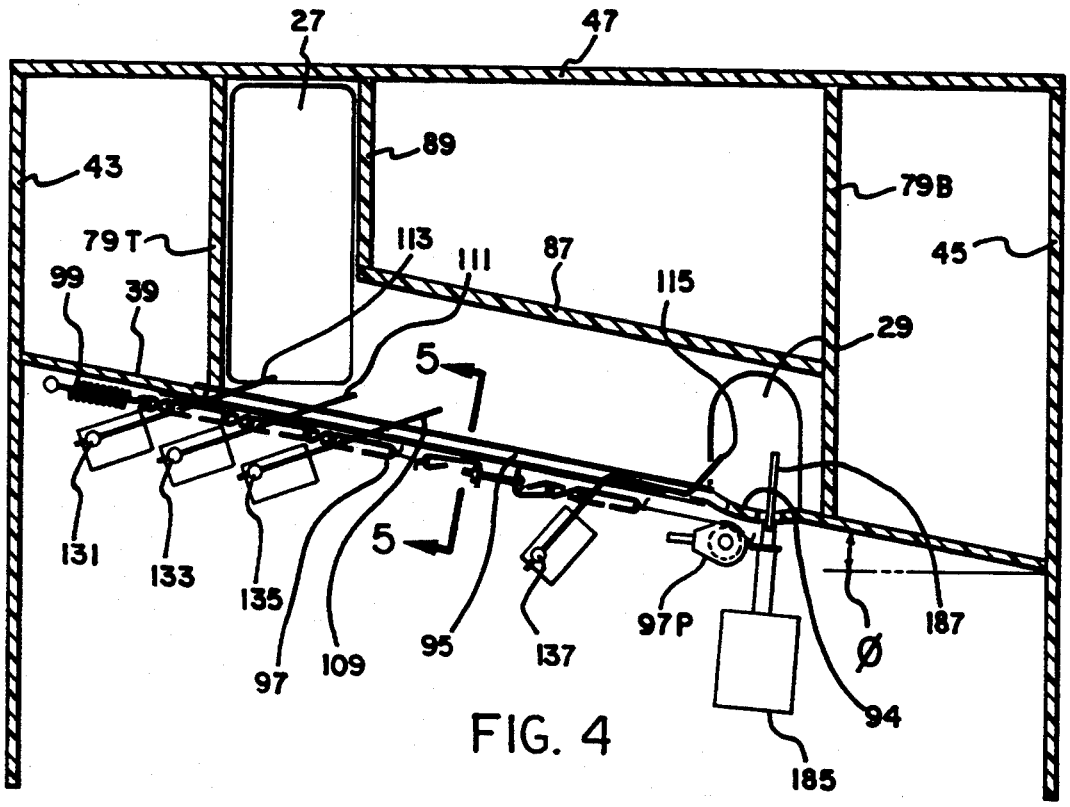
FIG. 4 is a cross-sectional view of the chute as seen from lines 4—4 of FIG. 3.
Figure 5:
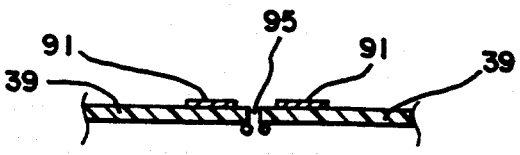
FIG. 5 is a cross-sectional view of the chute floor as seen from lines 5—5 of FIG. 3.

As shown in FIG. 4, switches 109, 111, 113 and 115 are mounted in the front section of the base 33 below the chute floor 39 and extend upwards through the slot 95. Each switch 109, 111, 113, 115 has a pivotal mount 131, 133, 135 and 137, respectively, below the chute floor 39 which toggles between a switch open position when the switch is located substantially parallel to the chute floor 39 and a switch closed position when the switch is located in its angled upright position. When no lottery ball is located on a switch, the pivotal mount of the switch causes the switch to rotate towards the top of the ramp 23T into the switch closed position. The switches 109, 111, 13, 115 are maintained in an angled position extending towards the bottom of the ramp 23B by linked tension wire 97 which extends between a pulley 97P and a spring 99 mounted to the switch assembly which is mounted to the base 15. Pulley 97P also is connected to the base. Each switch 109, 111, 113, and 115 extends through an opening of a link in the linked tension wire 97 which is routed over pulley 97D and attached to gate 187. The purpose of the linked tension wire is to pull the switches 109–135; 111–133; 113–131; and 115–137 down to allow the balls to roll down and through opening 29 without interference from the switches.

In operation, when a lottery ball is located over a switch the weight of the lottery ball forces the switch from its angled up position to extend substantially parallel to the chute floor. The switch opens when located substantially parallel to the chute floor. When the lottery ball is removed from over the switch the pivotal mount causes the switch to rotate back up to its angled up (closed) position.

In operation, of the ramp 23 lottery balls enter the chute 21 through the cage outlet opening 27. Each lottery ball rolls down the ramp 23 between the guide strips 91 to the lowest available position on the ramp 23. The first lottery ball to enter the ramp 23 is located adjacent the gate 187 and subsequent lottery balls entering the ramp 23 are located against the previous lottery ball to enter the ramp 23. The first lottery ball on the ramp 23 when located at the lower end is located over and depresses switch 115 and continues to depress the switch 115 until the gate 187 is open and the balls roll through opening 29 into the cage. The last three lottery balls on the ramp 23 depress switches 109, 111, and 113. Continued depression of switch 113 will occur when the ramp 23 is full and the motor 121 will be turned off. In a preferred embodiment the ramp 23 is capable of retaining six lottery balls thereon, however, the ramp 23 may be designed to accommodate more or less than six lottery balls.

When selection of the lottery balls is complete, the selected lottery balls on the ramp 23 may be viewed through the chute housing 25 and the transparent ramp housing 77. After viewing, release switch 127 located on the front of the motor housing 19 may be manually depressed to release the lottery balls on the ramp 23 back into the cage 13. Release switch 127 activates the solenoid 185 which retracts the gate 187 through the gate aperture 93 and also pulls the linked tension wire down which in turn pulls the switches 109–135; 111–133; 113–131; and 115–137 down. The lottery balls then roll down the ramp 23 in the delivery channel 94 and out the cage inlet aperture 29 into the cage 13.

Figure 6:
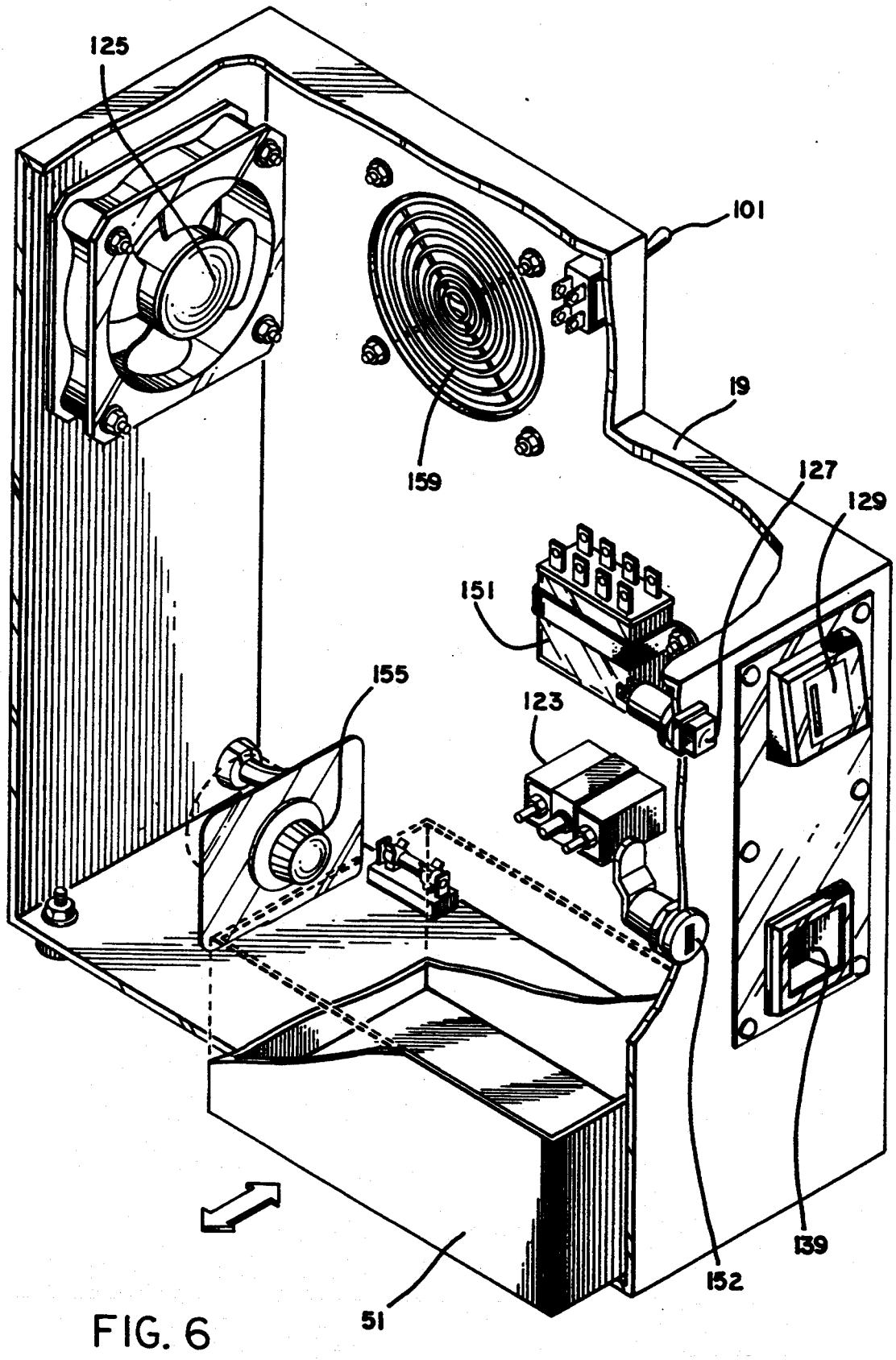
FIG. 6 is a cut away view of the motor housing of the apparatus of the invention.

As shown in FIG. 6, the motor housing 19 holds the release switch 127, a coin insertion slot 129, and a coin return slot 139 exposed along the front face of the motor housing 19. The coin insertion slot 129 is located over the coin box 51 so that coins inserted into the coin insertion slot fall into the coin box 51. Coins inserted into the coin box 51 activate the apparatus 11. A lock 152 is located on the front face of the motor housing 19 to prevent unauthorized access to the coin box 51 or the aperture 59 located within the motor housing 19.

The coin box 51 and the electric motor 121 are located within the motor housing 19. The coin box 51 is located in the lower front portion of the motor housing 19 to collect coins inserted into the coin insertion slot 129. As shown in FIG. 7, the electric motor 121 is mounted to a mounting plate 153 adjacent the cage wall 55 within the motor housing 19. The mounting plate 153 is coupled to the motor housing 19 adjacent cage wall 55.

The electric motor 121 is positioned within the motor housing 19 facing cage wall 55 to allow a shaft 121S, driven by a gear system 121G (coupled to the shaft of the motor) to be coupled to the paddle shaft 65. The paddle shaft 65 extends through cage wall 55 and the motor housing 19 to the electric motor 121. A motor speed control regulator 155 regulates the speed of rotation of the paddle shaft 65 by the electric motor 121. An on-off switch 101 located extending through the side face of the motor housing 19 provides power to the electric motor 121 from a power source outside the motor housing 19 when the switch 101 is closed. A fuse 188 prevents excess current.

Referring again to FIG. 7, cam 119, cam follower 119F, and switch 117 are associated with the electric motor 121 and paddle shaft 65 and cause the electric motor 121 to remain on after lottery balls have filled the ramp 23 until the paddle shaft 65 has been rotated to a position where the closest paddle 17 to the cage inlet opening 75 is located above the cage inlet opening 29. This prevents the lottery balls carried by the paddle from blocking the opening 29 to allow the balls in the chute to freely enter the cage enclosure 53 when released from the ramp 23.

The cam 119 is connected to the paddle shaft 65 between the electric motor 121 and the cage wall 55 within the motor housing 19. Cam follower 119F rides on cam 119 and extends between the cam 119 and switch 117. The switch 117 is mounted to the motor housing 19 adjacent the cage wall 55. The switch 117 turns the motor 121 off when the cam follower 119F is rotated to a position where the high point 119H of the cam 119 causes the cam follower 119F to open the switch 117. In this position, the closest paddle to the opening 29 will be above the opening.

Referring again to FIG. 6, a fan 125 is provided to cool the motor 121. The fan 125 is mounted extending through the upper back portion of the motor housing 19. An air inlet 159 is located extending through the side of the motor housing 19 proximate to the fan 125. The fan 125 in conjunction with the air inlet 159 circulates air through the motor housing 19 to cool the motor 121.

Figure 8:
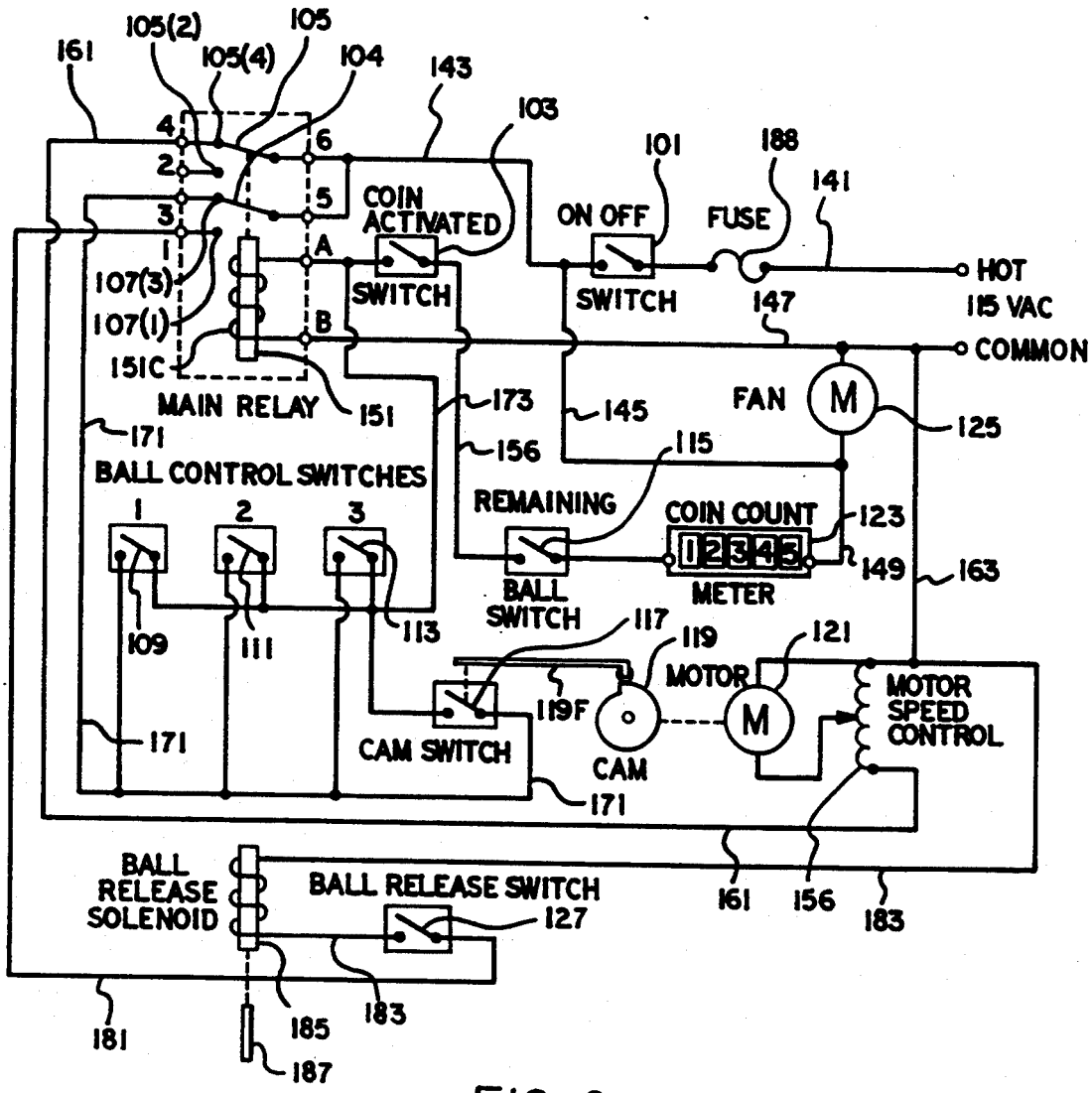
FIG. 8 is a schematic diagram of the electrical circuit of the apparatus of the invention.

Referring now to FIG. 8, the circuity of the lottery ball selector 11 will be described. Switches 101, 103, and 127 normally are open. Switches 105 and 107 normally engage contacts 105(2) and 107(1), respectively. Switches 109, 111, 113, and 115 normally are closed. Switch 117 is periodically opened and closed by cam follower 119F which rides on cam 119 which is rotated by the motor 121 when actuated.

In operation, switch 101 is manually closed. This applies current from lead 141 to leads 143 and 145. Current on lead 145 is applied to fan motor 125 and to common lead 147 which actuates the fan motor 125. Lead 145 is coupled by way of lead 149 to a coin count meter 123, normally closed switch 115, lead 150, the coil 151C of solenoid 151, normally closed switch 115, to switch 103.

When a coin is inserted into the coin box, switch 103 is momentarily closed, activating solenoid 151 which moves switches 105 and 107 to engage contacts 105(4) and 107(3) respectively. This applies current to leads 161 and 171 respectively. Current on lead 161 is applied to motor 121 and to common lead 147 by way of lead 163 which actuates the motor 121.

Current on lead 171 is applied to lead 173 by way of normally closed switches 109, 111, 113, and 115 to maintain the solenoid 151 actuated. As the balls are moved into the chute through the outlet opening of the cage or chamber, switches 113, 111, 109, and 115 are opened sequentially by the balls. After a ball passes each of switches 113,111, 109, and 115, the switch will close. Each of these switches will be opened continuously when a ball is positioned thereon. All four switches 109, 111, 113, and 115 are opened when five balls are in the chute. The solenoid 151, however, continues to be energized by way of current applied by way of leads 171, switch 117, as long as it is closed, and lead 173 until cam 119 is rotated by the motor 121 to allow the high point 119H of the cam 119 to move cam follower 119F to a position to open the switch 117. This causes the motor 121 to stop at a position such that the closest paddle to the inlet opening is just above the inlet opening of the chamber thereby maintaining the balls carried by the paddle above the inlet opening thereby preventing the balls carried by the closest paddle from blocking the return of the balls in the chute back into the cage or chamber by way of the inlet opening.

When switch 117 is opened, the solenoid 151 is deactivated and switch 107 engages contact 107(1) and switch 105 engages contact 105(2). This cuts off the motor 121 and applies current from leads 143 to lead 181. By manually closing switch 127, current is applied to lead 183 to actuate solenoid 185 to move the gate 187 out of the inlet opening, allowing the balls in the chute to roll into the cage of chamber by way of the inlet opening. As mentioned above the solenoid also pulls the linked tension wire down.

As long as balls are in the chute, switch 115 is in the open position. Once the motor has been stopped, it cannot be restarted as long as balls are in the chute since a ball on switch 115 opens the switch 115 and prevents the motor from being restarted. The motor thus cannot be restarted until all of the balls are out of the chute. This prevents one from emptying, for example, the first two balls from the chute (by closing switch 127) to try to obtain additional balls with more desired numbers thereon since switch 115 is still open by a ball in the chute will prevent the motor from being restarted.

The lottery ball selector 11 is sturdily constructed. The base 15 and the motor housing 19 are preferably formed of a metal material such as steel. The cage 13 and transparent portions of the chute 21 are formed of durable hard plastic.

The apparatus may be modified to allow the apparatus to be played with more or less than 50 balls and to allow the apparatus to select more or less than 6 balls in the chute.

We claim:

1. A lottery ball mixing and selecting apparatus, comprising:

a cage comprising wall structure with a bottom wall defining a bottom portion for use for holding a plurality of balls;

a chute adjacent said cage for accepting a selected number of balls therein;

an outlet formed through said wall structure forming a passageway from said cage to said chute for allowing balls to enter said chute from said cage;

a rotatable paddle located in said cage above said bottom wall;

an electric motor coupled to said rotatable paddle for rotating said paddle for moving said paddle past said outlet for use for engaging and moving balls in said cage toward said outlet for entry into said chute, an inlet formed through said wall structure forming a passageway from said chute to said cage for allowing balls to enter said cage from said chute.

2. The apparatus of claim 1, wherein:

said paddle comprises a solid portion for supporting a ball and a slotted portion having a slot located next to said solid portion and in line with said outlet as said paddle is rotated past said outlet, said slot having a size sufficient to allow a ball to pass therethrough for entry into said chute by way of said outlet.

3. The apparatus of claim 1, comprising a plurality of balls located in said cage.

4. A lottery ball mixing and selecting apparatus, comprising:

a cage for use for holding a plurality of balls;

a chute adjacent said cage for accepting a selected number of balls therein;

an outlet from said cage to said chute for allowing balls to enter said chute from said cage;

a rotatable paddle located in said cage;

an electric motor coupled to said rotatable paddle for rotating said paddle for moving said paddle past said outlet for use for engaging and moving balls in said cage toward said outlet for entry into said chute;

an inlet from said chute to said cage for allowing balls to enter said cage from said chute;

an electrical circuit which includes at least one switch located in said chute which is movable to a given position to deactivate said motor when a desired number of balls are in said chute.

5. The apparatus of claim 4, further comprising:

a gate located in said inlet for controlling access of balls from said chute to said cage through said inlet;

control means for moving said gate to an open position to allow balls to roll from said chute through said inlet into said cage.

6. The apparatus of claim 5, wherein:

said chute has an upper end and a lower end;

said outlet from said cage to said chute is located adjacent an upper end of said chute;

said inlet from said cage to said chute is located adjacent a lower end of said chute.

7. The apparatus of claim 6, wherein:

said electrical circuit includes a switch for activating said control means for moving said gate to said open position when balls located in said chute are to be released from said chute into said cage.

8. The apparatus of claim 7, wherein:

said chute is enclosed by a plurality of chute walls and by said wall structure of said cage, at least one of said chute walls is formed of a transparent material so that balls located in said chute may be viewed through said transparent material.

9. The apparatus of claim 8, further comprising:

a base upon which said cage and said chute are located.

10. The apparatus of claim 4, wherein said electrical circuit comprises:

a power lead, a normally closed remaining ball switch, a coin operated switch, and a solenoid coil coupled in series to said power lead, two normally open solenoid switches coupled to said power lead, one of said solenoid switches being coupled to said motor, a plurality of normally closed chute switches located in said chute which are all open when the desired number of balls are in said chute, each of said chute switches having a first lead connected to a common lead and a second lead connected to the second lead of an adjacent switch, said common lead being connected to the other of said solenoid switches, said second lead of the last chute switch furtherest from said inlet being coupled to said power lead between said coin operated switch and said solenoid coil, said coin operated switch when closed applying electrical power to said solenoid coil for closing said solenoid switches, said second lead from said last chute switch applying power to said solenoid coil when said last chute switch is closed and when said coin operated switch opens, a cam operated switch which is opened and closed upon rotation of said paddle device, said cam operated switch having a first lead coupled to said common lead and a second lead coupled to said second lead of said last chute switch for applying power to said solenoid coil after said last chute switch opens until said cam operated switch is opened to locate said paddle device away from said inlet when said motor is disengaged, said remaining ball switch being normally closed and opening when a ball is located thereon, a gate for normally blocking said inlet, and means for opening said gate to allow balls in said chute to roll back into said cage.

11. The apparatus of claim 4, comprising a plurality of balls located in said cage.

12. A lottery ball mixing and selecting apparatus, comprising:

a cage having a cylindrical wall with an inside surface and a central axis with a bottom wall portion for use for holding a plurality of balls, a chute adjacent said cage for accepting a selected number of balls therein, a first passageway extending through said cylindrical wall above said bottom wall portion to said chute for allowing balls to enter said chute from said cage, a second passageway extending through said cylindrical wall to said cage for allowing balls to enter said cage from said chute, a rotatable paddle located in said cage above said bottom wall portion, rotating means coupled to said paddle from rotating said paddle about said axis next to the inside surface of said cylindrical wall and past said first passageway for use for engaging and moving balls in said cage upward toward said first passageway for entry into said chute.

13. The apparatus of claim 12, wherein:

said rotating means comprises an electric motor;

an electrical circuit which includes at least one switch located in said chute which is movable to a given position to deactivate said motor when a desired number of balls are in said chute.

14. The apparatus of claim 13, comprising:

a gate for controlling access of balls from the chute to the cage through said inlet;

control means for moving said gate to an open position to allow balls to roll from said chute through said inlet into said cage.

15. The apparatus of claim 14, wherein:

said chute has an upper end and a lower end;

said first passageway is located adjacent an upper end of said chute;

said second passageway is located adjacent a lower end of said chute.

16. The apparatus of claim 15, wherein:

said electrical circuit includes a switch for activating said control means for moving said gate to said open position when balls located in said chute are to be released from said chute into said cage.

17. The apparatus of claim 12, wherein:

said paddle comprises a solid portion for supporting a ball and a slotted portion having a slot located next to said solid portion and in line with said first passageway as said paddle is rotated past said first passageway, said slot having a size sufficient to allow a ball to pass therethrough for entry into said chute by way of said first passageway.

18. The apparatus of claim 10, comprising a plurality of balls located in said cage.

* * * * *